United States Patent [19]

Michals et al.

[11] 4,421,427

[45] Dec. 20, 1983

[54] SHORTHAND MACHINE HAVING ELECTRIC PLATEN ADVANCEMENT

[75] Inventors: Richard A. Michals, Skokie; Frank H. Mozer, Hoffman Estates; Ralph E. Zum Bahlen, Chicago, all of Ill.

[73] Assignee: Stenograph Corporation, Skokie, Ill.

[21] Appl. No.: 426,861

[22] Filed: Sep. 29, 1982

Related U.S. Application Data

[62] Division of Ser. No. 195,923, Oct. 10, 1980, Pat. No. 4,363,558.

[51] Int. Cl.[3] ..... B41J 3/26; B41J 23/34; B41J 23/08

[52] U.S. Cl. ..... 400/94; 400/187

[58] Field of Search ..... 400/187, 92–94

[56] References Cited

U.S. PATENT DOCUMENTS

| | | | |
|---|---|---|---|
| 1,614,473 | 1/1927 | Hokanson | 400/187 |
| 1,755,281 | 4/1930 | Reppert | 400/187 |
| 2,593,371 | 4/1952 | Watson | 400/94 |
| 3,038,578 | 6/1962 | Ryan et al. | 400/187 |
| 3,062,350 | 11/1962 | Demmel | 400/187 |
| 4,247,208 | 1/1981 | Fulkerson et al. | 400/94 |

FOREIGN PATENT DOCUMENTS

| | | | |
|---|---|---|---|
| 2108004 | 8/1972 | Fed. Rep. of Germany | 400/187 |

*Primary Examiner*—William Pieprz

*Attorney, Agent, or Firm*—Lee, Smith & Jager

[57] ABSTRACT

A shorthand machine including an electric drive system to advance the platen. In accordance with the invention, the platen can be advanced in a fully mechanical, conventional mode, fully electric mode, or by a combination of electric and mechanical drives. In the electric or electric/mechanical modes, after the shorthand machine operator makes a key stroke and releases the keys, an electric circuit pulses an electric motor connected to the platen to drive the platen for a predetermined duration of time. Subsequent to the driving pulse, power to the motor is reversed to quickly brake the motor and bring it to a rapid stop. The duration of time that the motor is activated may be varied, varying the amount of advancement of the platen, and thus varying the distance between recorded key strokes for each word or part of word generated by the operator of the shorthand machine.

6 Claims, 6 Drawing Figures

Fig. 1.
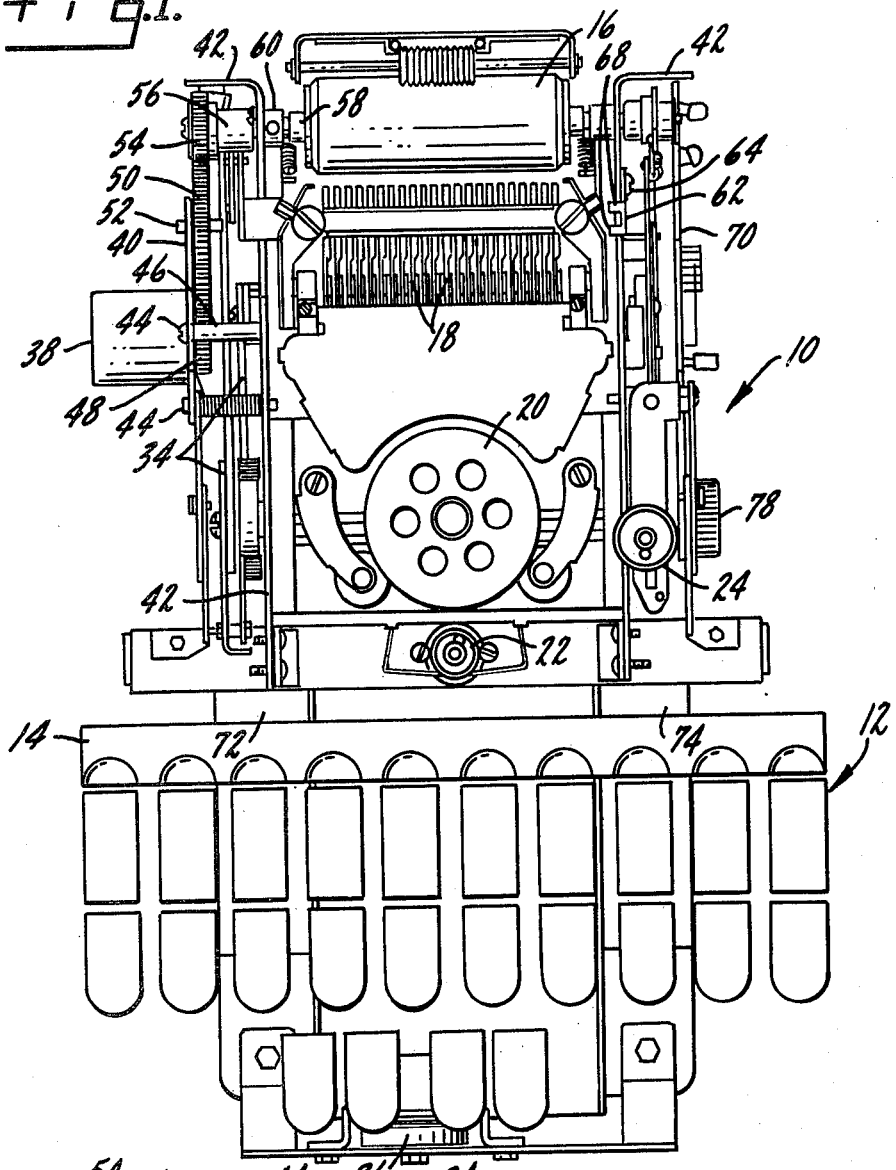
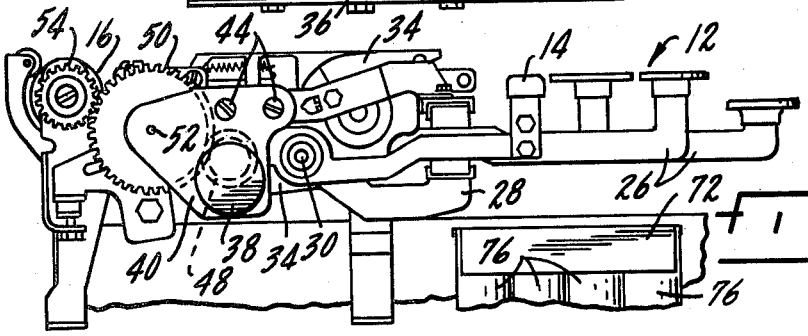
Fig. 2.

Fig. 3.
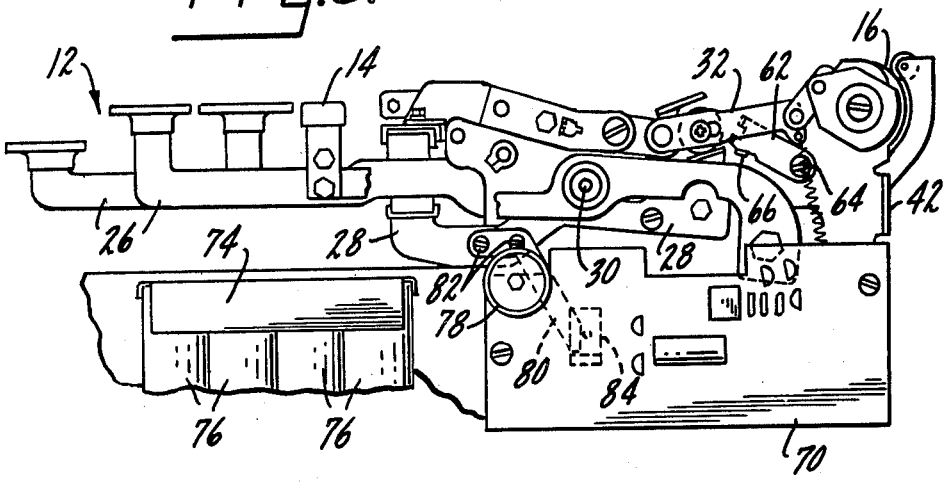
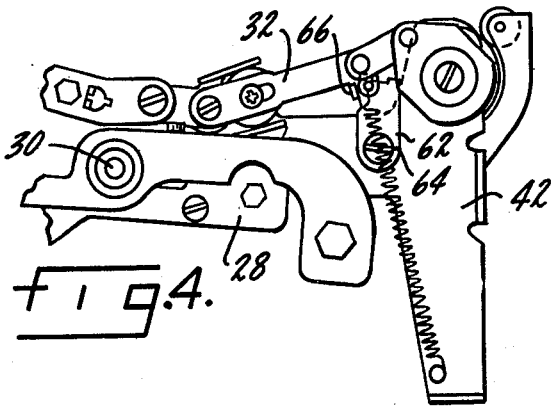
Fig. 4.
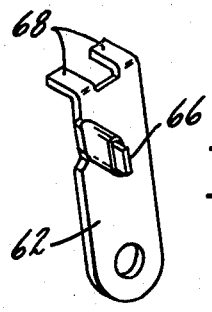
Fig. 5.

SHORTHAND MACHINE HAVING ELECTRIC PLATEN ADVANCEMENT

This is a division, of application Ser. No. 195,923, filed Oct. 10, 1980 now U.S. Pat. No. 4,363,558.

BACKGROUND OF THE INVENTION

This invention relates to shorthand machines, and in particular to a system for electrically advancing the platen of a shorthand machine.

Shorthand machines are commonly used in reporting conferences, court hearings and the like, and in most situations where it is desired to record the spoken word in a visual form. Shorthand machines manufactured by the assignee of the present invention have operated successfully and efficiently for many decades.

The common shorthand machine has a keyboard of 22 phonetically-related characters which, to the skilled operator, provides all combinations necessary to record words and numbers. The record produced by the machine may be a paper tape on which the phonetic characters are printed, as generally described in U.S. Pat. No. 2,319,273 which was assigned to the predecessor of the assignee of the present invention, or may be recorded on a magnetic medium, as set forth in greater detail in U.S. Pat. Nos. 3,557,927 and 4,205,351, also assigned to the assignee of the present invention.

To record a word or parts of a word in a prior art shorthand machine, the machine operator presses an appropriate combination of the keys and the machine mechanically prints the characters simultaneously on a paper tape or, in the case of electric recordation, combinations of electrical pulses are recorded on a magnetic tape. In either case, the magnetic or paper tape is advanced a specific interval before recordation of each succeeding combination of keys pressed by the machine operator.

When a paper tape record is employed, the platen is advanced by the pressure of the operator's fingers upon the keys of the machine. In other words, the platen is mechanically advanced by the operator. During long periods of dictation, the operator often becomes fatigued and mechanical operation of the machine becomes burdensome, raising the possibility that the operator, when fatigued, may improperly record the spoken proceedings.

For the purposes of this description, the following terms are used and are given their intended meaning as understood in the art:

The term "stroke" refers to the act of an operator engaging the keys of the shorthand machine with sufficient force to impress a symbol or character on the paper tape, and/or to produce an electrical output representing the symbol. The stroke may be engagement of a single key, or any number of the keys, with the release of the last engaged key completing the stroke. A series of strokes is recorded sequentially on the paper tape or the magnetic medium.

The terms "symbol" and/or "character" mean any representation of a word construction including, but not limited to, letters of the alphabet and numerals.

The terms "word" or "phonetic words" means a particular combination of the characters of the shorthand machine which may form all or part of the phonetic representation of a spoken word.

SUMMARY OF THE INVENTION

The present invention is directed to a system for electrically advancing the platen of a shorthand machine. The system is primarily intended to be selectively used with or as an alternative to the mechanical platen advance mechanisms found on present day shorthand machines, although other utilities of the system in connection with platen advancement will become apparent as well. The system is well suited as an adjunct to mechanical shorthand machines presently sold by the assignee of the present invention.

The system comprises, in combination, an electric motor connected for driving the platen of the shorthand machine. Electrical power is provided to the electric motor to advance the platen responsive to each key stroke by the machine operator. After the platen is advanced, the system includes means to stop the motor subsequent to a predetermined duration of time, thereby halting advancement of the platen and preparing the system for the next stroke.

To activate the motor, the system includes means to sense each stroke and generate a signal indicative of completion of a stroke. That signal causes generation of a motor activation pulse which continues for a predetermined duration of time. The motor activation pulse activates a motor driving circuit which energizes the motor to advance the platen for the duration of the motor activation pulse.

To sense each stroke, the system includes an optical interruptor having an optical signal generator and an optical signal receiver spanning a gap across which light may pass. The optical signal generator is normally pulsed to generate light pulses across the gap in order to activate the optical signal receiver. A flag is connected to the universal bar of the keys of the shorthand machine and, during a stroke, penetrates the gap to inhibit passage of light. During the completion of a stroke, the flag leaves the gap, permitting light to once again pass, and permitting the generation of a motor activation pulse. The pulse is generated for a predetermined duration of time dictated by a timing means, which is variable in order to adjust the predetermined duration of time. The motor activation pulse activates a switch which provides electrical power to drive the motor.

Subsequent to the duration of the motor activation pulse, the motor is rapidly stopped. This is accomplished by sensing the counter or back electromotive force of the motor and supplying electrical power to the motor of a polarity reverse to that supplied to the motor when operated to advance the platen. The reverse polarity power is supplied so long as the counter electromotive force of the motor exceeds a predetermined threshold value.

According to the invention, the platen may be advanced purely electrically, or may be advanced by a combination of typical mechanical advancement and the electrical advancement of the invention. In addition, should the system of the invention become inoperative or should the operator so desire, the shorthand machine can be operated in a fully mechanical mode in a common manner without using any part of the invention.

BRIEF DESCRIPTION OF THE DRAWINGS

The invention is described in greater detail in the following description of the preferred embodiment, taken in conjunction with the drawings, in which:

FIG. 1 is a top plan view of a shorthand machine according to the invention, with common portions omitted for clarity of description, FIG. 2 is a side elevational view on a reduced scale illustrating a portion of the left-hand side of the shorthand machine of FIG. 1, illustrating the means for electrically advancing the platen, FIG. 3 is a side elevational view on a reduced scale illustrating a portion of the right-hand side of the shorthand machine of FIG. 1, including a schematic representation of some of the electrical circuitry and the means used to inhibit mechanical advancement of the platen, FIG. 4 is an enlarged side elevational illustration of a portion of the shorthand machine of FIG. 3, showing in greater detail the mechanical linkage to drive the platen and the means in which functioning of the mechanical linkage may be inhibited, FIG. 5 is a further enlarged perspective view of the means used to inhibit mechanical advancement of the platen.

DESCRIPTION OF THE PREFERRED EMBODIMENT

Figure 6:
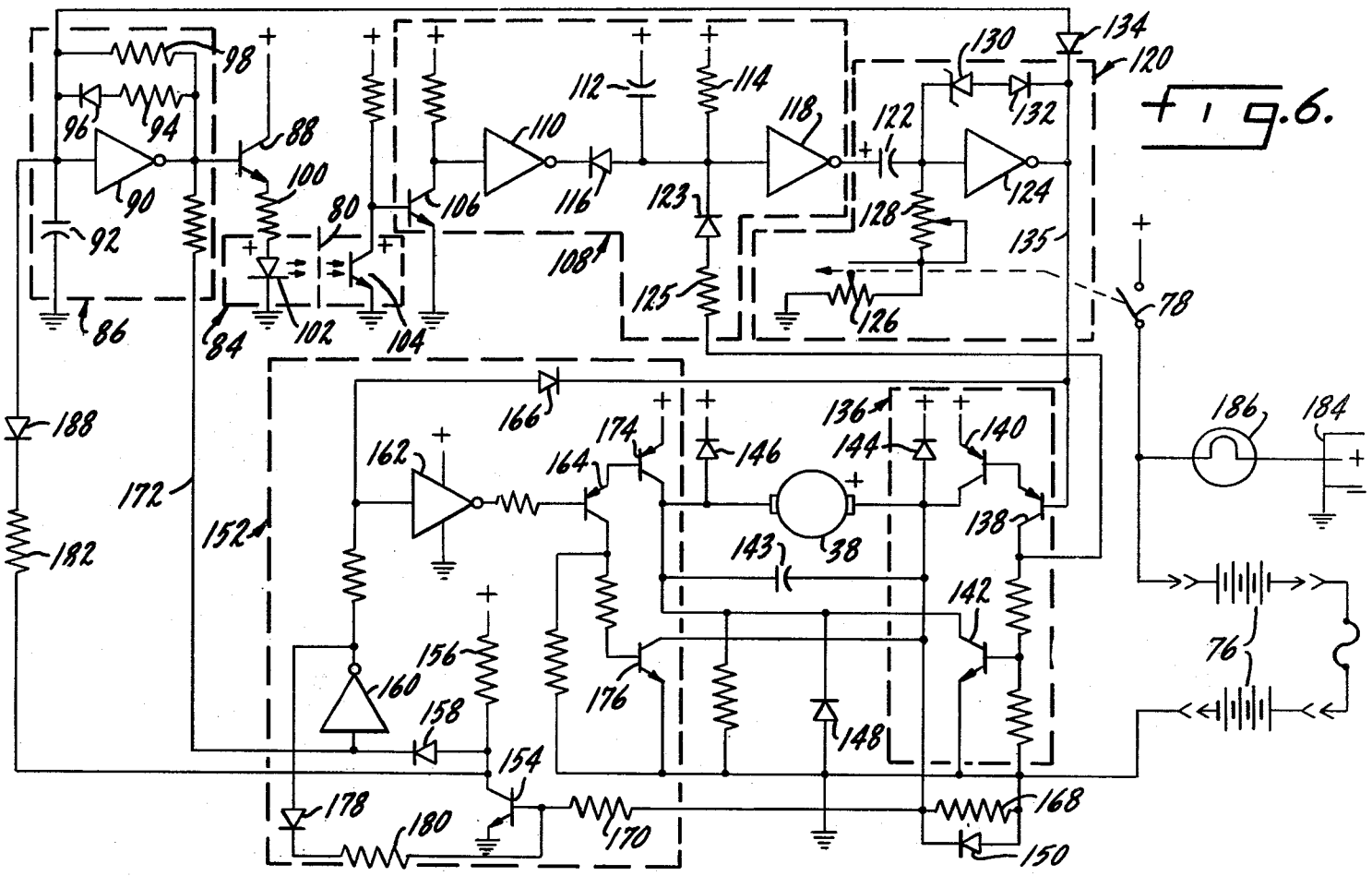
FIG. 6 is a schematic illustration of the electrical circuitry used in connection with the invention.

A shorthand transcribing machine incorporating the features of the present invention is illustrated in the drawings and is designated, in general, by the reference numeral 10. As is well known, the shorthand machine 10 is housed within a shell, not illustrated, to protect the machine and enhance its appearance. Such a shell, and other omitted components of the shorthand machine, are shown and described in greater detail in above-identified U.S. Pat. No. 2,319,273, which is incorporated herein by reference.

The shorthand machine 10 includes a keyboard 12 having a plurality of keys which, when stroked by an operator, produce a sequential paper-tape record of the words spoken. Each key has been identified by an alpha-numeric symbol which is reproduced at the paper tape when the key is stroked by the operator. A numeral bar 14, when pressed, shifts those keys representing both letter and numeral symbols from the letter symbol mode to the respective numeral symbol mode.

The paper tape (not illustrated) is stored in the machine 10 in folds and is transported over a rubber platen 16 positioned remote from the keyboard 12. A type bar 18 is associated with each key and is advanced toward the platen 16 when the particular key is stroked. An inked ribbon (not illustrated) is wound about a spool 20 and is fed between the type bars 18 and the platen 16. The paper tape is automatically advanced by rotation of the platen 16 each time one or more of the keys of the keyboard 12 is stroked. The type bars 18 associated with the stroked keys urge the inked ribbon into contact with the paper at the platen 16 for impressing characters on the paper tape.

As is conventional with shorthand machines maunfactured by the assignee of the present invention, the shorthand machine may also include a stroke adjustment 22 which is used to change the spacing of each stroke recorded on the paper when the machine 10 is operated in the mechanical mode. Also, the machine may include a keyboard tension adjustment mechanism 24 to enable the operator to vary the pressure required to stroke the keys of the keyboard 12. The keyboard tension adjustment 24 and the stroke adjustment 22 are conventional and will not be described in greater detail.

As best shown in FIG. 3, when the operator strokes any of the keys of the keyboard 12 (with the exception of the numeral bar 14), the associated key lever 26 presses a universal bar 28 which is pivoted at a pin 30 attached to the frame of the machine 10. Thus, the portion of the pivoted universal bar 28 remote from the key levers 26 (to the right of the pin 30 in FIG. 3) is raised, activating a mechanical linkage and clutch mechanism 32 and advancing the platen 16. A detailed description of the linkage and the platen advancement is found in U.S. Pat. No. 2,393,781, which is incorporated herein by reference.

At the same time that one or more of the keys of the keyboard 12 is stroked, the associated key lever 26 engages a type bar and ribbon advancement linkage 34, advancing the associated type bar 18 into contact with the paper tape against the platen 16. The means and linkage for advancing the type bars 18 is conventional and is described in somewhat greater detail in above-identified U.S. Pat. No. 4,205,351.

Also shown partly in FIG. 1 is a portion of a paper gauge 36 used to visually indicate to the machine operator the quantity of paper tape remaining in the shorthand machine. The paper gauge is the subject of U.S. patent application Ser. No. 123,122, filed Feb. 21, 1980, and assigned to the assignee of the present invention.

The electrical platen driving means according to the invention is shown at the upper left-hand side of FIG. 1 and also in the side elevational illustration of FIG. 2. As shown, the invention includes an electric motor 38 affixed to a mounting bracket 40 which is attached to the frame 42 of the machine 10 by one or more screws 44. Spacers 46 maintain a desired spacing between the mounting bracket 40 and the frame 42. The motor 38 drives the platen 16 through a gear train extending between the motor 38 and the platen 16. The motor 38 directly drives a gear 48 which in turn drives a gear 50 journalled on an axle 52 affixed in the mounting bracket 40. A gear 54, affixed to the axle 58 of the platen 16, is in turn driven by the gear 50. Preferably, although not mandatory, the diameters of the gears 48 and 54 are equal, so that there is equal correspondence between advancement of the platen 16 and rotation of the gear 48 by the motor 38.

As shown in FIG. 1, the gear 54 is attached to a clutch 56 which in turn is attached to drive the axle 58 of the platen 16. The clutch 56 permits rotation of the platen 16 in only one direction (counterclockwise in FIG. 2) as described in greater detail in above-referenced U.S. Pat. No. 2,393,781. The axle 58 is journalled through a bearing 60 attached to the frame 42.

For the shorthand machine 10 to function only in the electrical mode, the mechanical linkage and clutch mechanism 32 must be inhibited from operation during strokes of the keys of the keyboard 12. To this end, a locking arm 62 is pivotally attached to the frame 42 by a screw 64. As best shown in FIG. 5, the locking arm 62 includes a protruding leg 66 which, when the locking arm 62 is pivoted into the upright position as shown in FIG. 4, engages the mechanical linkage 32, raising the linkage as shown, and preventing the mechanical linkage and clutch mechanism 32 from advancing the platen 16. When the locking arm 62 is in the position illustrated in FIG. 3, however, the mechanical linkage 32 is allowed to function in its normal manner. To facilitate pivoting of the locking arm 62 between the positions shown in FIGS. 3 and 4, the arm 62 preferably includes a pair of fingers 68. The machine operator may pivot the locking arm 62 by inserting a pen or other relatively pointed instrument between the two fingers 68 and rotating the locking arm 62 to the position desired.

Also shown diagrammatically in FIG. 3 is a circuit board 70 which carries the electronic circuit elements (FIG. 6) for activation of and driving of the motor 38. Various transistors, resistors, etc. of the circuitry of FIG. 6 are depicted on the circuit board 70 for the purposes of illustration, but are not meant to necessarily signify any particular one of the circuit elements.

To supply electric power to the circuit elements and the motor 38, the machine 10 includes a pair of battery packs 72 and 74 carrying a plurality of batteries 76 mounted on opposite sides of the machine 10. Electrical leads (not illustrated), interconnect the battery packs 72 and 74 and the circuitry mounted on the circuit board 70.

Also shown in FIG. 3 is a switch 78 which, as described in greater detail in connection with FIG. 6, provides power to the circuitry and motor 38, and which includes a variable resistor for alteration of the duration of the motor activation pulse.

As shown in FIG. 3, a flag 80 is attached by screws 82 to the universal bar 28. The flag 80 is mounted to enter the gap of an optical signal generator 84, which is described in greater detail in connection with the circuitry depicted in FIG. 6. In the position shown in FIG. 3, when no key of the keyboard 12 has been depressed, the flag 80 has not entered the gap of the optical signal generator 84 sufficiently to interrupt the beam generated by the optical signal generator. However, when one of the keys of the keyboard 12 is depressed, the universal bar 28 is depressed, as described above, causing the flag 80 to enter the gap of the optical signal generator 84 and inhibit light from passing across the gap.

Turning now to the circuitry of FIG. 6 which is employed to activate the motor 38 to drive the platen 16, the following description characterizes the circuit elements and their respective functions. As known to those skilled in the art, other circuit elements may be used in substitution for or addition to the elements shown in FIG. 6 without departing from the novel features of the invention.

A non-symmetrical oscillator 86 is used to generate short duration positive pulses to an emitter follower transistor 88 which, as shown, is connected to the optical signal generator 84. The oscillator 86 includes an inverter 90. When the output of the inverter 90 is positive, capacitor 92 is charged through resistor 94 and diode 96. When the charge on capacitor 92 reaches the positive input threshold of the inverter 90, the output of the inverter 90 goes low and capacitor 92 discharges through resistor 98. Diode 96 prevents discharge of the capacitor 92 through the resistor 94. Preferably, the resistive value of resistor 98 is substantially greater than that of resistor 94, so that the output of the inverter 90 appears as a positive pulse train of short-pulse duration with longer periods between each pulse to achieve a low rate of power use between each activation of the keys of the keyboard 12.

The pulses from the output of the oscillator 86 are directed to the base of the emitter follower transistor 88. Each of the pulses causes the transistor 88 to conduct, thus causing positive voltage pulses to pass from the transistor 88 through a resistor 100 to the optical signal generator 84. The signal generator includes a photo diode 102 and a photo transistor sensor 104. Pulses from the transistor 88 are applied to the photo diode 102 which emits light pulses between a gap separating the diode 102 from the photo transistor 104. Each light pulse to the photo transistor 104 causes the transistor 104 to conduct.

The output of the optical signal generator 84 on the collector of the transistor 104 is connected to the base of a transistor 106 in the motor trigger circuit 108. The motor trigger circuit 108 is used to provide a signal representative of each stroke of the keys of the keyboard 12.

When the photo transistor 104 is not conducting (light pulses are not falling on its base), the base of transistor 106 is normally high and therefore transistor 106 is conducting. With each pulse of the oscillator 86, however, the transistor 104 conducts, drawing the base of the transistor 106 low, and therefore turning off the transistor 106. The voltage on the collector of the transistor 106 is presented to an inverter 110 where it is inverted. Therefore, the output of the inverter 110 tracks exactly the output of the oscillator 86 so long as the beam passing between the photo diode 102 and photo transistor 104 of the optical signal generator 86 is not broken.

When the output of inverter 110 is low, a capacitor 112 is charged to positive reference voltage. When the output of the inverter 110 is high, capacitor 112 discharges through a resistor 114. Diode 116 prevents discharge of the capacitor 112 to the inverter 110.

When the machine operator depresses a key of the keyboard 12, the flag 80 breaks the beam in the optical signal generator 84. Thus, photo transistor 104 fails to conduct and the transistor 106 remains in the conducting state. At this time, the capacitor 112 discharges. As the capacitor 112 discharges to the positive input threshold level of an inverter 118, the output of the inverter 118, which is normally high, goes low, and is directed to the spacing one-shot circuit 120.

Since the output of inverter 118 is normally high, a timing capacitor 122 of the one-shot circuit 120 is normally charged. When the output of inverter 118 goes low, the timing capacitor 122 is discharged. At the end of the machine operator's stroke, when the key or keys of the keyboard 12 are released and the flag 80 is withdrawn from the optical signal generator 84, the first positive pulse appearing at the input of the inverter 110 causes rapid charging of the capacitor 112. As the voltage at the input of the inverter 118 passes its lower threshold value, the output of inverter 118 becomes high, and its high voltage level is passed through the capacitor 122 to the input of an inverter 124, where it is inverted, a low level appearing on the output of the inverter 124.

When the output of the inverter 118 switches from a low to a high level, the timing capacitor 122 begins to charge through a timing control resistor 126, which forms part of the switch 78, and a second trimming resistor 128. Both resistors 126 and 128 are variable, the resistor 128 to dictate the minimum charging time for the capacitor 122, and the resistor 126 to control the charging time between the minimum and a selected maximum. With the slider of the trimming resistor 128 in its determined position and the slider of the timing control resistor 126 at its left-most location, the minimum charging time for the capacitor 122 is produced. With the slider of the timing control resistor 126 as far to the right as possible, the maximum charging time is produced.

As explained above, when the output of the inverter 118 switches from a low to a high level, the inverter 124 switches from a high to a low level. At the same time, the timing capacitor 122 begins to charge. Zener diode 130 and diode 132 limit the voltage rise at the input to the inverter 124. As the capacitor 122 charges, the input voltage to the inverter 124 decays exponentially until the lower threshold level of the inverter 124 is reached. At this point, the output of the inverter 124 then goes high, terminating the motor activation pulse.

By referencing the voltage rise at the input to the inverter 124 to the threshold level of the inverter, the termination of the motor activation pulse changes with battery voltage. Thus, when the battery voltage is reduced through age, etc., the input threshold level of inverter 124 is lowered, requiring a longer time for the capacitor 122 to charge to the threshold level, thereby producing a longer motor activation pulse to compensate for the reduced power going to the motor 38.

If a key of the keyboard 12 is depressed while the output of the inverter 124 is low (that is, during the motor activation pulse), a diode 123 and resistor 125 rapidly discharge the capacitor 112 in the motor trigger circuit 108, causing the inverter 118 to rapidly switch to a low output, thereby switching the inverter 124 to a high output and terminating the motor activation pulse.

While the output of the inverter 124 is low (during generation of the motor activation pulse), the output is directed through a diode 134 to the input of inverter 90 of the oscillator 86. Thus, for the duration of the motor activation pulse, the output of the inverter 90 is held high, holding the output of the optical signal generator 84 high to eliminate any delay should a key be stroked and the flag 80 enter the gap in the optical signal generator 84 while the motor 38 is operating.

The output of the inverter 124 is directed on a line 135 to a motor control circuit 136. When a low motor activation pulse appears on line 135, transistor 138 conducts. The conducting of transistor 138 in turn causes a transistor 140 to conduct, directing positive reference voltage to the motor 38. At the same time, the collector current of the transistor 138 turns on a transistor 142, bringing the opposite side of the motor 38 to ground and turning on the motor 38. A capacitor 143 and diodes 144, 146, 148 and 150 are used to shunt commutation noise spikes from the motor 38.

After the duration of the motor activation pulse on line 135, the voltage to the base of the transistor 138 is again high, inhibiting the transistors 138 and 140 and preventing positive voltage from being applied to the motor 38 through the transistor 140. Also, since the transistor 138 is not conducting, the transistor 142 also ceases conducting.

As soon as the motor activation pulse has been completed, the motor stopping circuit 152 is activated to reverse the polarity of the power applied to the motor 38 to rapidly brake the motor. The reverse power continues until the motor is effectively halted.

During standby operation of the motor 38, a transistor 154 is not conducting. Thus, positive voltage is applied through resistor 156 and diode 158 to an inverter 160 whose output is normally low during this period. The output of the inverter 160 is directed to an inverter 162, whose output is therefore high, preventing a transistor 164 from conducting. Also during the normal activation of the motor 38, the motor activation pulse on the line 135 is passed through a diode 166 to the input of the inverter 162, causing a positive voltage to be directed to the transistor 164 and preventing its conducting.

Subsequent to the motor activation pulse, the back or counter electromotive force (EMF) of the motor 38 appears on the resistor 168. This voltage is presented through a resistor 170 to the base of a transistor 154, causing the transistor 154 to conduct. While the transistor 154 conducts, the inverter 160 is released from the application of positive voltage through the resistor 156 and diode 158. Thus, pulses from the oscillator 86 are applied to the inverter 160 via line 172. When the oscillator pulse on the line 172 is low, the output of the inverter 160 is high, causing the output of the inverter 162 to be low. Consequently, the transistor 164 begins to conduct, causing a transistor 174 to conduct, applying power of a reverse polarity to the motor 38. At the same time, the collector current of the transistor 164 causes a transistor 176 to conduct, bringing the opposite side of the motor 38 to ground. Thus, opposite polarity power is applied to the motor 38, bringing the motor rapidly to a stop. The output of the inverter 160 is also applied via diode 178 and resistor 180 to the base of transistor 154, when the output of the inverter 160 is high.

If, after a low oscillator pulse (which turns on the stop circuit 152) followed by a high oscillator pulse (which halts the brake power), the motor is still turning, the counter EMF of the motor continues to be generated across the resistor 168, again being applied to the base of the transistor 154 and permitting the inverter 160 to accept another low oscillator pulse. Therefore, the braking cycle is repeated until such time as the counter EMF of the motor 38 is sufficiently low so that the transistor 154 can no longer conduct. After this lower threshold level is reached, the stop circuit 152 is inactivated, and oscillator pulses on the line 172 no longer have any effect.

Also during the braking operation, the frequency of the oscillator 86 is increased. When the transistor 154 is conducting, a resistor 182 and diode 188 shunt the resistor 98. If the resistor 182 is of a lower resistive value than the resistor 98, the capacitor 92 will discharge through the resistor 182 during each oscillation pulse. The increased frequency of the oscillator 86 caused thereby causes activation of the stop circuit 152 with greater repetition during the braking operation, resulting in more constant advancement of the platen 16 subsequent to each stroke of the keys of the keyboard 12.

To charge the batteries 76, a source of direct current shown generally at 184 may be supplied. The source 184 may be any suitable type of charger, and typically is connected to a jack (not illustrated) on the shorthand machine 10. A lamp 186 is used to indicate that the batteries 76 are being charged.

Various changes may be made to the invention without departing from the spirit thereof or the scope of the following claims.

What is claimed is:

1. In a shorthand machine of the type having a set of keys wherein numerals, or words or parts of words, are generated by a stroke which comprises depressing and releasing a key or combination of keys, and a universal member mounted for engagement by the keys and movable in response to a stroke of the keys, the improvement comprising:

a. mechanical drive means for mechanically advancing the platen in response to a stroke of the keys, said mechanical drive means including clutch means mechanically coupled to the platen and movable from a rest position to an advanced position, said movement effecting rotation of the platen, said clutch means when in said rest position being positioned in the path of movement of said universal member, whereby said clutch means may be engaged and moved by said universal member from said rest position to said advanced position to effect rotation of the platen in response to each stroke of the keys, b. electrical drive means operable independently of said mechanical drive means for electrically advancing the platen in response to a stroke of the keys, c. selecting means including a locking mechanism for selectively moving said clutch means from its rest position to its advanced position and holding said clutch means in its advanced position out of the path of movement of said universal member whereby said mechanical drive means may be selectively rendered inoperative.

2. A shorthand machine according to claim 1 in which said mechanical drive means is responsive to depression of a key or combination of keys and said electrical drive means is responsive to release of a key or combination of keys.

3. The shorthand machine according to claim 1 in which said electrical drive means includes an electric motor and a circuit for energizing said electric motor in response to a stroke of the keys when said circuit is connected to a source of electrical energy, and said selecting means further includes switch means for selectively connecting said motor circuit to a source of electrical energy.

4. A shorthand machine according to claim 3 in which said locking mechanism comprises an arm pivotally attached to the shorthand machine.

5. A shorthand machine according to claim 4 in which said arm includes means to facilitate pivoting thereof.

6. A shorthand machine according to claim 5 in which said means to facilitate comprises a pair of spaced fingers protruding from said arm.

* * * * *